United States Patent [19]

Tolan

[11] 4,073,420

[45] Feb. 14, 1978

[54] PULL ROLL APPARATUS

[75] Inventor: John R. Tolan, South Bend, Ind.

[73] Assignee: Milliken Research Corporation, Spartanburg, S.C.

[21] Appl. No.: 751,516

[22] Filed: Dec. 16, 1976

Related U.S. Application Data

[63] Continuation of Ser. No. 616,500, Sept. 24, 1975, abandoned.

[51] Int. Cl.[2] ..... B65H 25/04

[52] U.S. Cl. ..... 226/42; 226/44; 226/109

[58] Field of Search ..... 226/42, 43, 44, 108, 226/109

[56] References Cited

U.S. PATENT DOCUMENTS

| | | | |
|---|---|---|---|
| 3,404,820 | 10/1968 | Marano | 226/44 X |
| 3,912,145 | 10/1975 | Meihofer | 226/44 |

*Primary Examiner*—Richard A. Schacher
*Attorney, Agent, or Firm*—Robert S. Alexander; H. William Petry

[57] ABSTRACT

Apparatus for controlling the transfer of a continuous cord including a first roll means, drive means for the first roll means, a second roll means pivotably mounted adjacent the first roll means, position-detecting control means operatively connected to the second roll means and means for changing the speed of the drive means in response to changes in the control means.

2 Claims, 4 Drawing Figures

PULL ROLL APPARATUS

This is a continuation of application Ser. No. 616,500, filed on Sept. 24, 1975 now abandoned.

This invention relates to an apparatus for controlling the rate of transfer of a continuous cord or strip and more particularly relates to an apparatus for maintaining a substantially constant tension in a continuously advancing cord or strip.

It has been proposed to employ continuous cord or strip in the manufacture of tread reinforcing belts for use in belted tires. Such belts may be formed by winding one or more cords or strips onto a rotating drum in a generally zigzag pattern employing reciprocating guides to position the cords or strips. Examples of such prcedures are disclosed in U.S. Pat. Nos. 2,982,327; 3,720,569; 3,720,570; 3,748,203 and 3,761,341.

One of the problems in producing a commercially successful tire belt is maintaining the configuration and dimensions of the belt within close tolerances. To insure a uniform pattern, it is important that the tension in the cord or strip be maintained substantially constant during the winding operation.

The present invention provides a novel apparatus for transferring one or more cords or strips at substantially constant tension. Furthermore, the apparatus of the invention provides for the detection of changes in tension and the adjustment of the transfer speeds to provide substantially constant tension therein. Moreover, the apparatus of the invention is capable of controlling the tension of several cords or strips while the cords or strips are being transferred at a high rate of speed.

Other advantages and benefits of the invention will be apparent from the following detailed discussion and description of the drawings in which.

Figure 1:
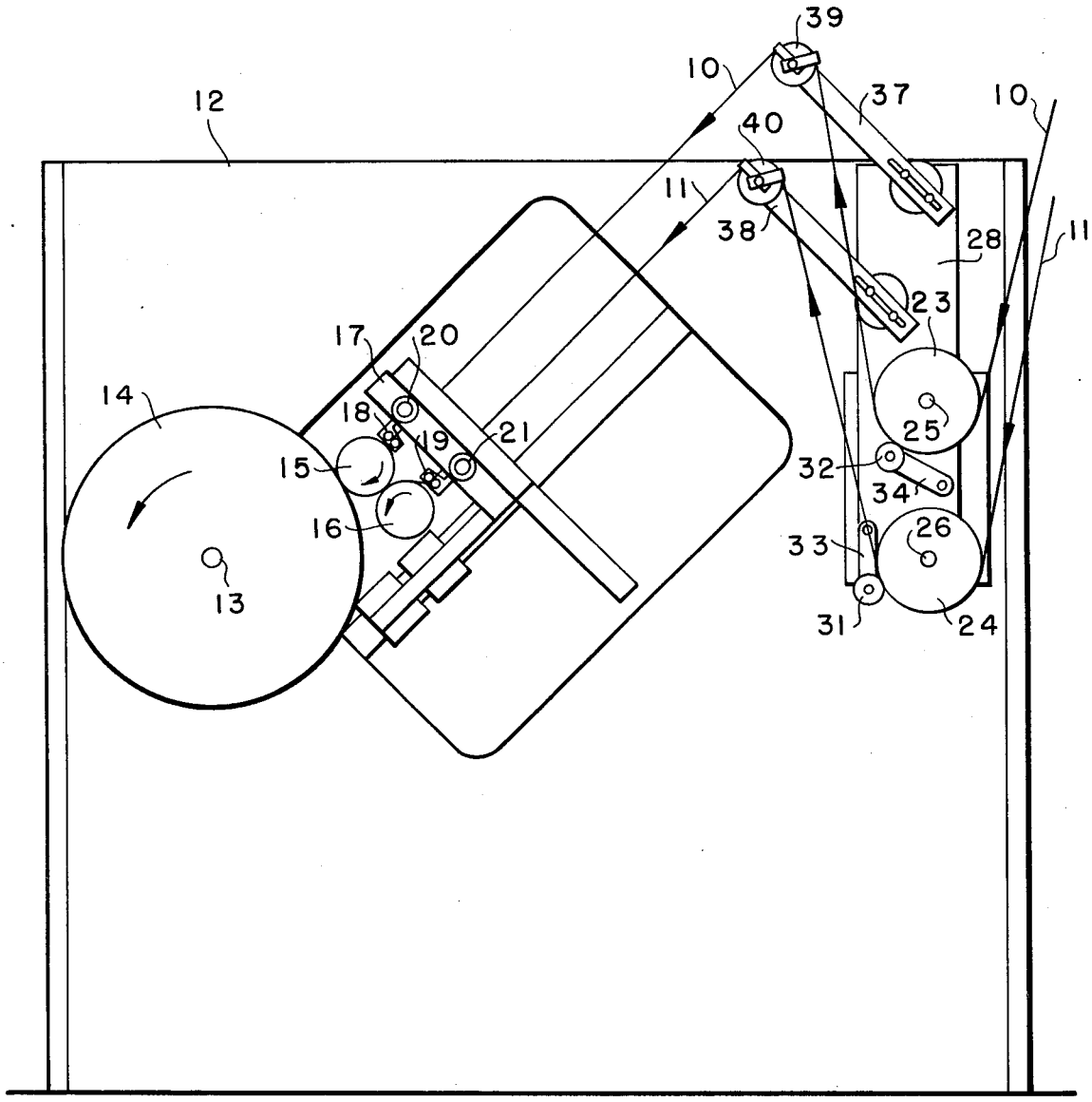
FIG. 1 is a schematic front elevation of one form of apparatus of the invention for controlling cord or strip tension.
Figure 4:
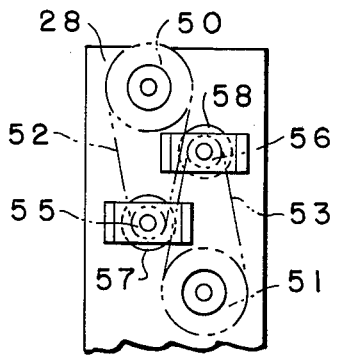
FIG. 4 is a fragmentary view taken along line 4—4 of FIG. 3.
Figure 2:
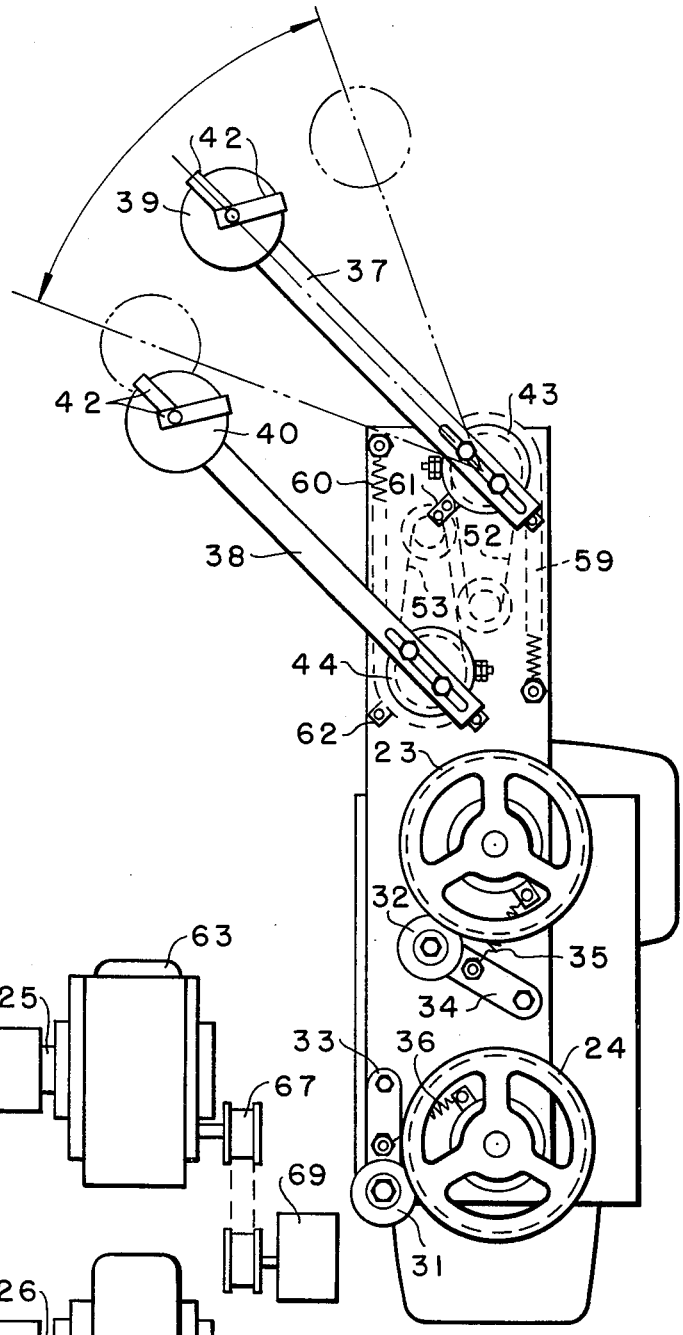
FIG. 2 is an enlarged view showing the tension controlling portion of the apparatus of FIG. 1.
Figure 3:
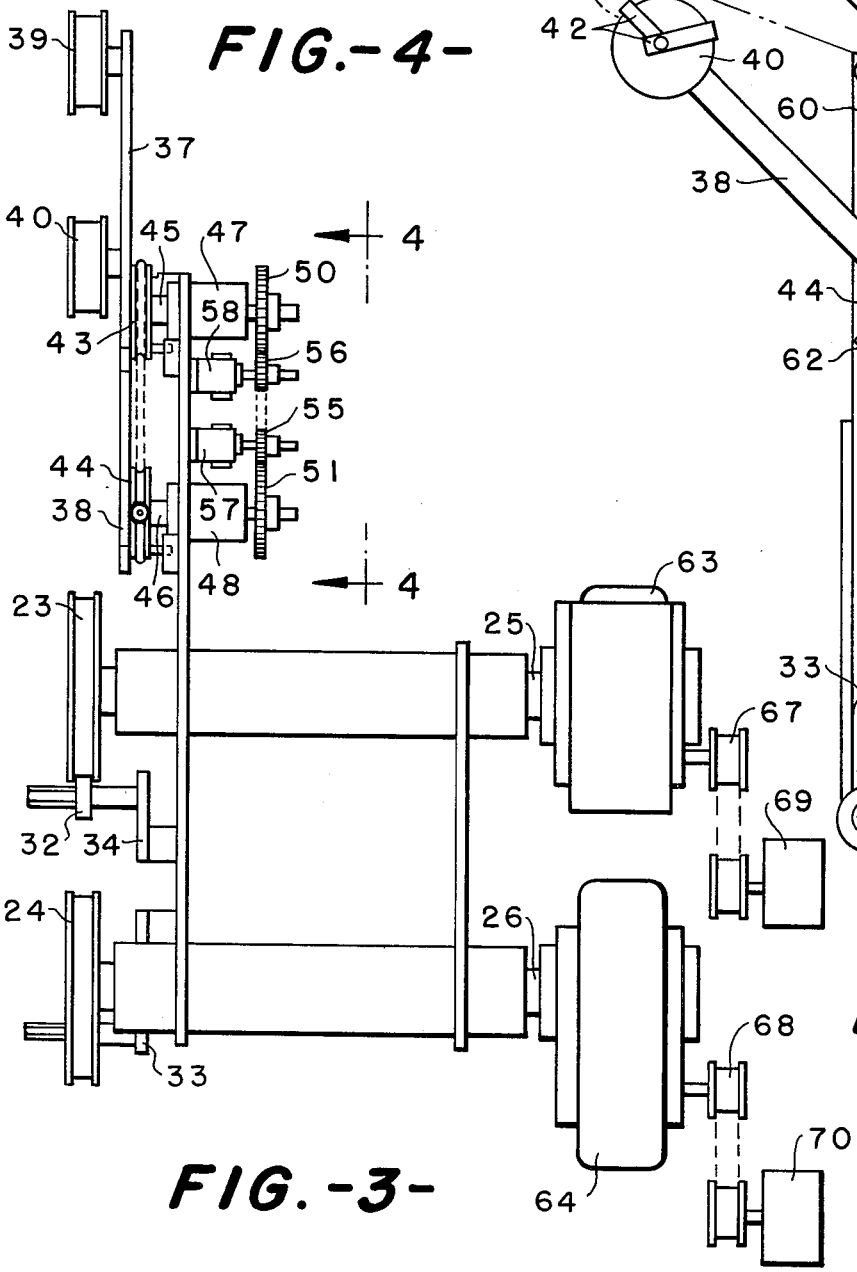
FIG. 3 is a right side view of the apparatus shown in FIG. 2.

As shown in the drawings, one form of apparatus for controlling tension in cords or strips being continuously transferred includes a frame 12 having extending therefrom a shaft 13 on which is mounted a rotatable drum 14. Positioned adjacent the drum 14 and extending from the frame are a press roll 15, a transfer roll 16 and a guide frame 17. Guide frame 17 has reciprocating guide members 18 and 19 secured to traverse rods 20 and 21 respectively. Sheaves 23 and 24 are mounted for rotation on shafts 25 and 26 respectively which extend from mounting plate 28 secured to frame 12. Rollers 31 and 32 mounted on arms 33 and 34 respectively are biased against the sheaves by springs 35 and 36.

Above the sheaves 23 and 24 are pivotally positioned arms 37 and 38 on which are mounted freely rotatable sheaves 39 and 40. Guards 42 are attached to the arms 37 and 38 via shafts passing through sheaves 39 and 40. The opposite ends of arms 37 and 38 are secured to grooved flanges or pulleys 43 and 44 mounted on rotatable shafts 45 and 46 disposed within housings 47 and 48. On the ends of the shafts 45 and 46 are secured sprockets 50 and 51. Chains 52 and 53 connect the sprockets 50 and 51 respectively to sprockets 55 and 56 secured to position-detecting control means responsive to changes in position, e.g., potentiometers 57 and 58 which are mounted on the reverse side of mounting plate 28.

The arms 37 and 38 are biased in a clockwise direction by springs 59 and 60 which are disposed within the grooves of flanges 43 and 44 with one end attached to a pin in the groove of the respective flange and the other end to the mounting plate 28. Stop blocks 61 and 62 secured to mounting plate 28 and positioned in the plane of arms 37 and 38 prevent excess rotation of the arms.

Sheaves 23 and 24 are connected to speed reducers 63 and 64 through shafts 25 and 26. Speed reducers 63 and 64 are connected by suitable belt and pulley arrangements 67 and 68 to motors 69 and 70. Advantageously, speed reducers 63 and 64 include a one way clutch feature to prevent backing up of cords or strips being advanced through the apparatus In the operation of the apparatus shown in the drawings, strips 10 and 11 are drawn from a rubber extruder or other supply source (not shown) and wrapped around sheaves 23 and 24. The strips 10 and 11 are maintained in contact with the grooves of the respective sheaves 23 and 24 by biased rollers 31 and 32.

To maintain proper tension in the strips being pulled through guide members 18 and 19, by rotation of drum 14, changes in tension are detected and corresponding changes are made in the speed at which the sheaves 23 and 24 rotate. This is accomplished with the apparatus of the invention through sheaves 39 and 40 mounted at the ends of arms 37 and 38 which engage the strips as they are transferred from the sheaves 23 and 24 to the guide members 18 and 19. Since the arms and sheaves are biased against the strips by springs 59 and 60, the arms will pivot in a clockwise direction as the tension in the strips decreases and in a counterclockwise direction as the tension in the strips increases. These changes in the position of the arms 37 and 38 are transferred to potentiometers 57 and 58 through the chains 52 and 53 and sprockets 50, 55 and 51, 56. The potentiometers in turn change the electrical voltage supplied to the motors 69 and 70 through appropriate control equipment (not shown) and thereby change the speed of the respective motors to cause the sheaves 23 and 24 to draw each strip through the apparatus at the appropriate corrective rate to maintain proper tension in the strip.

The above description and drawings show that the present invention provides a novel apparatus for controlling the delivery of cord or strip. Furthermore, the apparatus provides for the detection of changes in tension and the adjustment of the speed of delivery by a simple arrangement of components.

It will be apparent that modification and variations in the apparatus described in detail and shown in the drawings may be made within the scope of the invention. For example, in place of the potentiometers, mechanical, pneumatic, hydraulic or other position-detecting devices which control speed in response to changes in position may be employed. Also, the arrangement of the various elements may be changed to accommodate the transfer of different structures or to meet space limitations. Therefore, the invention is to be limited only by the following claims.

That which is claimed is:

1. Apparatus to supply a plurality of continuous cords to a drum comprising:

a frame;

a drum rotatably mounted on said frame;

a first pulley member having a groove around its outer periphery pivotably mounted on said frame;

a second pulley member having a groove around its outer periphery pivotably mounted on said frame;

a first arm mounted on said first pulley;

a second arm mounted on said second pulley;

a third pulley rotatably mounted on said first arm at one end thereof;

a fourth pulley rotatably connected to said second arm at one end thereof;

a first drive sprocket operably connected to said first arm at the end opposite to said third pulley;

a second drive sprocket operably connected to said second arm at the end opposite to said fourth pulley;

a first roll means for supplying continuous cord over said third pulley to said drum;

a second roll means for supplying a continuous cord over said fourth pulley to said drum;

biasing means biasing each arm against the traction of said cord, each said biasing means including a pin member disposed within the groove of said pulley member, a spring member one end of which is attached to said pin member the other end of which is attached to said frame;

a separate drive means for each of said rolls, each said drive means including a one-way clutch means;

a first potentiometer, having a shaft and operably connected with the drive means for first roll;

a second potentiometer, having a shaft and operably connected with the drive means for said second roll;

a first driven sprocket mounted on the shaft of the first potentiometer;

a second driven sprocket, mounted on the shaft of said second potentiometer;

a first chain means connecting the first driven sprocket to the first drive sprocket; and a second chain means connecting the second driven sprocket to the second drive sprocket.

2. Apparatus to supply a plurality of continuous cords to a drum, comprising:

a frame;

a drum, rotatably mounted on said frame;

a first shaft member rotatably mounted on said frame;

a second shaft member rotatably mounted on said frame;

a first pulley member having a groove around its outer periphery mounted on said first shaft member;

a second pulley member having a groove around its outer periphery rigidly mounted on said second shaft member;

a first arm having one end rigidly mounted on said first pulley member;

a second arm having one end rigidly mounted on said second pulley member;

a third pulley member rotatably mounted on said first arm at the end opposite said first pulley member;

a fourth pulley member rotatably mounted on said second arm at the end opposite said second pulley member;

a first drive sprocket mounted on said first shaft member;

a second drive sprocket mounted on said second shaft member;

a first roll means for supplying continuous cord over said third pulley to said drums;

a first pressing roll means for maintaining continuous cord in contact with said first roll means;

a second roll means for supplying continuous cord over said fourth pulley to said drum;

a second pressing roll means for maintaining continuous cord in contact with said second roll means;

biasing means biasing each arm against the traction of said cord, each said biasing means including a pin member disposed within the groove of said pulley member, a spring member, one end of which is attached to sain pin member, the other end of which is attached to said frame;

a separate drive means for each of said rolls, each of said drive means including a one-way clutch means;

a first potentiometer mounted on said frame, and operably connected to the drive means for said first roll;

a second potentiometer mounted on said frame, and operably connected to the drive means for said second roll;

a first driven sprocket mounted on the shaft of said first potentiometer;

a second driven sprocket mounted on the shaft of said second potentiometer;

a first chain means connecting the first driven sprocket to the first drive sprocket;

a second chain means connecting the second driven sprocket to the second drive sprocket;

a first stop means for limiting the angular rotation of said first arm;

a second stop means for limiting the angular rotation of said second arm;

a first guard means mounted on said third pulley means for holding continuous cord in contact with said third pulley means; and a second guard means mounted on said fourth pulley means for holding continuous cord in contact with said fourth pulley member.

* * * * *

UNITED STATES PATENT OFFICE

CERTIFICATE OF CORRECTION

Patent No. 4,073,420 Dated February 14, 1978

Inventor(s) John R. Tolan

It is certified that error appears in the above-identified patent and that said Letters Patent are hereby corrected as shown below:

Column 1, line 15, delete the word "prcedures" and substitute therefor --procedures--.

Column 2, line 53, delete the word "modification" and substitute therefor --modifications--.

Column 4, line 26, delete the word "sain" and substitute therefor --said--.

Signed and Sealed this

Sixth Day of June 1978

[SEAL]

*Attest:*

RUTH C. MASON
*Attesting Officer*

DONALD W. BANNER
*Commissioner of Patents and Trademarks*